US007856744B2

(12) United States Patent
Crow et al.

(10) Patent No.: US 7,856,744 B2
(45) Date of Patent: Dec. 28, 2010

(54) WINE BOTTLE GREETING CARD

(76) Inventors: Michelle Lynn Crow, 9191 Justen Trail North, Stillwater, MN (US) 55082; Lora Jean Torgerson, 2039 100th St. East, Inver Grove Heights, MN (US) 55077

( * ) Notice: Subject to any disclaimer, the term of this patent is extended or adjusted under 35 U.S.C. 154(b) by 0 days.

(21) Appl. No.: 11/753,998

(22) Filed: May 25, 2007

(65) Prior Publication Data

US 2008/0010872 A1 Jan. 17, 2008

Related U.S. Application Data

(60) Provisional application No. 60/810,052, filed on Jun. 1, 2006.

(51) Int. Cl.
*G09F 3/00* (2006.01)

(52) U.S. Cl. ..... 40/310

(58) Field of Classification Search ..... 40/310, 40/331, 332, 660
See application file for complete search history.

(56) References Cited

U.S. PATENT DOCUMENTS

| | | | | | |
|---|---|---|---|---|---|
| 1,984,559 | A * | 12/1934 | Wilcox | 229/74 |
| 3,149,431 | A * | 9/1964 | Blish | 40/311 |
| 3,831,300 | A * | 8/1974 | Berkhouse | 40/310 |
| 5,960,973 | A * | 10/1999 | Markson | 215/386 |
| 6,597,653 | B1 * | 7/2003 | Burnett | 369/273 |
| 6,643,964 | B1 * | 11/2003 | Stern | 40/599 |
| 6,799,390 | B2 * | 10/2004 | Bradley | 40/310 |

* cited by examiner

*Primary Examiner*—Gary C Hoge
(74) *Attorney, Agent, or Firm*—Dorsey & Whitney LLP

(57) ABSTRACT

The present invention is a bottle greeting card comprising a card upon which graphics and text may be displayed, a cutout from the card adapted to fit over the neck of a bottle, and at least one of graphics and text printed on the card.

10 Claims, 3 Drawing Sheets

WINE BOTTLE GREETING CARD

CROSS-REFERENCE TO RELATED APPLICATION

This application claims priority to U.S. provisional patent application Ser. No. 60/810,052, filed Jun. 1, 2006, which is incorporated herein by reference in its entirety.

FIELD OF THE INVENTION

The present invention relates to an apparatus and method for a greeting card that is readily attachable to objects such as bottles.

BACKGROUND OF THE INVENTION

The present invention relates to cards. In particular, the present invention relates to a card that may be attached to objects such as bottles. Typically, when a person gives a bottle of wine as a gift with an accompanying card, the card is separate from the bottle. A problem with this arrangement is that if the card and the wine bottle are separated, then the recipient may not know the identity of the person who brought the wine bottle.

There is a need in the art for an apparatus that allows for attachment of a card to objects such as bottles.

BRIEF SUMMARY OF THE INVENTION

The present invention, in one embodiment, is a bottle greeting card comprising a card upon which graphics and text may be displayed, a cutout from the card adapted to fit over the neck of a bottle, and at least one of graphics and text printed on the card.

The present invention, in another embodiment, is an object greeting card, comprising a means for displaying a greetings message, a card upon which graphics and text may be displayed, and means for attaching the display means to a bottle.

In yet another embodiment, the present invention is a method for attaching a bottle greeting card to a bottle, comprising placing the greeting card around a neck of the bottle through a cutout formed in the greeting card and folding the card so that it lays flat against the bottle.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying Figures, in which:

DETAILED DESCRIPTION

The greeting card of the present invention is a unique and innovative greeting card to be used with bottled products and packaged gifts by slipping the precut hole over the neck of a bottle, or attaching it to any packaged gift. With a greeting card attached to a bottled product or packaged gift, it replaces the need for a greeting card or gift tag when used for personal use, and functions as a promotional use greeting tag when offered by a business. With the unique design of the greeting card of the present invention, not only is the complete greeting that consists of graphics, greeting text and signature box entirely on the front side of the card, but it creates form utility by being directly attached to any bottled product simply by slipping the precut hole on the greeting card over the neck of a bottle. Also, the greeting card can be taped to any packed gift, and the bow can be placed inside the hole of the greeting card. Birthdays, holidays, red-letter days, and special occasions are just some of many occasions for which the greeting card of the present invention can be used to dress-up any bottled or packaged gift to complete the gift presentation. Consumers can purchase the greeting card for their personal use and businesses can use the greeting card for their promotional use. In fact, businesses, companies and organizations can customize the greeting card for their own marketing campaigns. For example, a business that makes and distributes wine may wish to convey holiday greetings on their bottled products, and offer a free greeting card for gift purchases of their bottled product. The greeting card of the present invention is the only card that matches the physical characteristics of a promotional tag on bottled products but, at the same time, is designed to function as a greeting card to create a greeting card for bottled products and packaged gifts.

Figure 1:
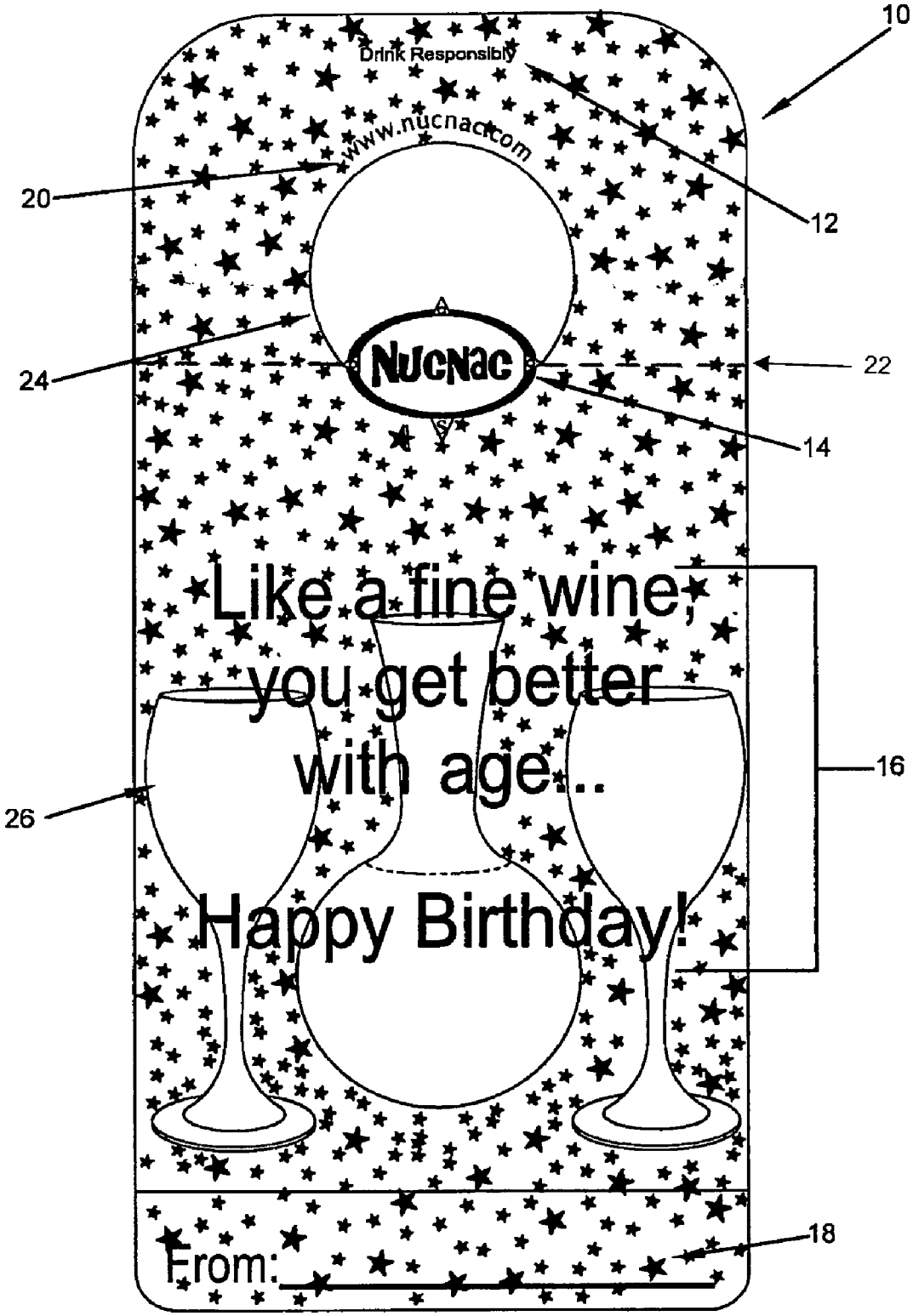
FIG. 1 is the front side of the greeting card of the present invention.
Figure 2:
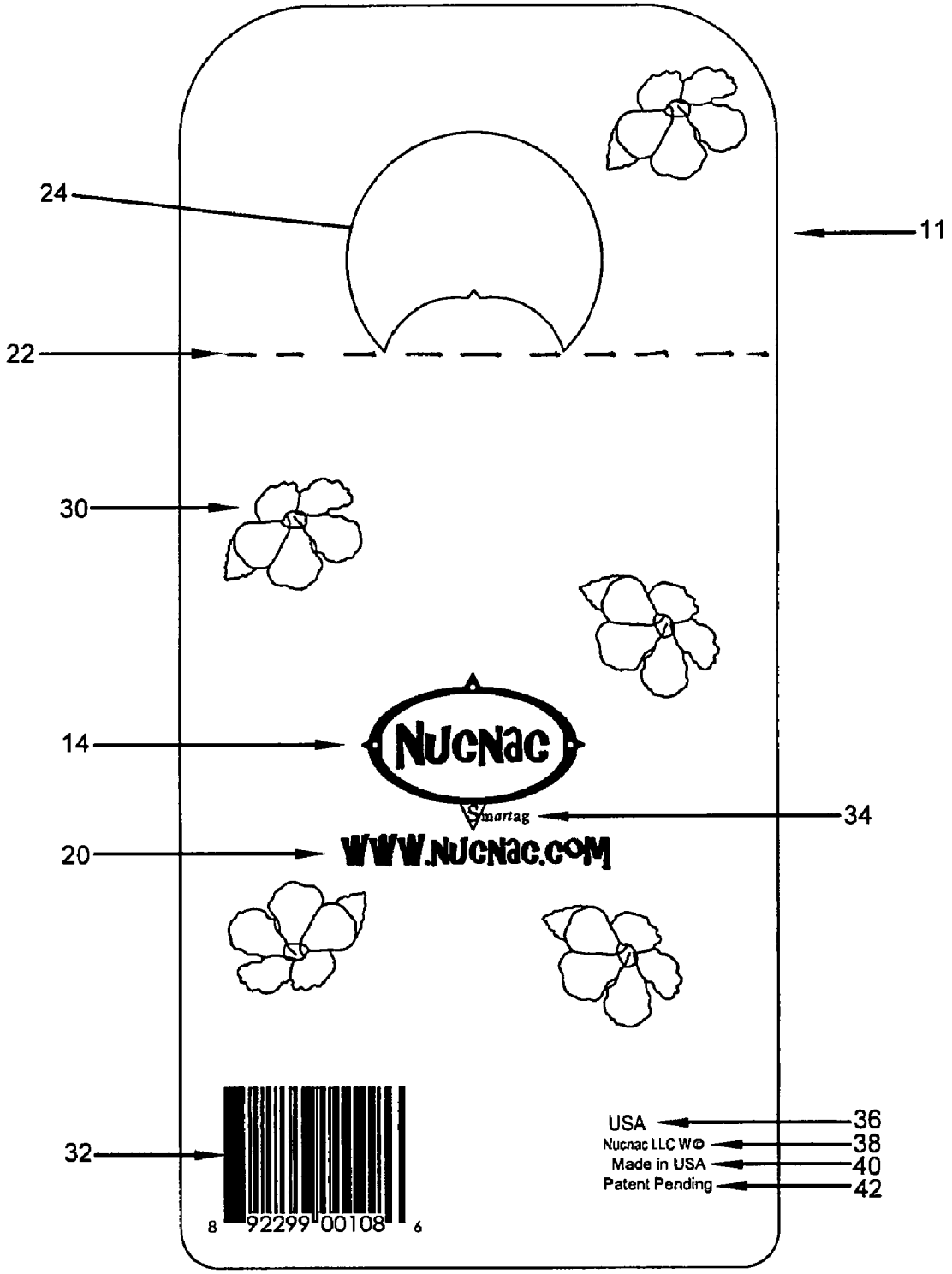
FIG. 2 is the back side of the greeting card of the present invention.
Figure 3:
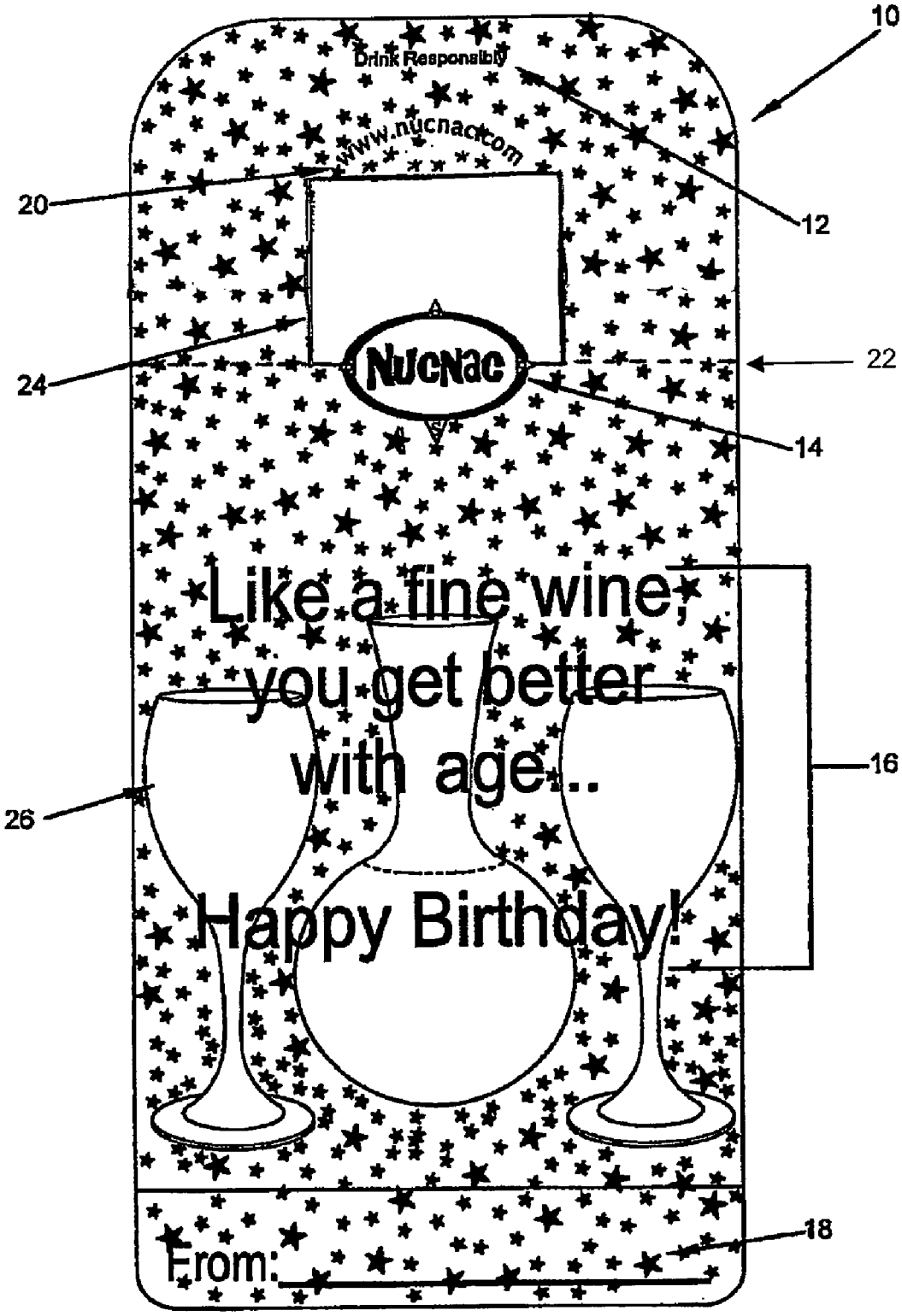
FIG. 3 is a greeting card of the present invention having a rectangular precut hole.

FIG. 1 illustrates the front side 10 of one embodiment of the present invention. The greeting card is configured so that one end of the card fits over the neck of a bottle, which permits the other end of the card, which includes graphics, a message, or other text, to hang down a portion of the length of the bottle. In particular, the greeting card is attached to the neck of a bottle by means of precut hole 24. Precut hole 24 is a circle that is completely enclosed in the greeting card, which is adapted to fit over the neck of standard bottles, such as wine bottles, that may be given as gifts. The dimensions of precut hole 24 should be large enough such that the neck of the bottle fits within precut hole 24, but should not be so large that the widest part of the bottle would fit within it. Thus, the greeting card should hang easily on the neck of the bottle without sliding off. By way of illustration, precut hole 24 may have a diameter of 1-518" that is centered 1" from the top of the card. It is understood, however, that the diameter of precut hole 24 may be larger or smaller than 1⅝", however, so long as it is large enough to accommodate the neck of a bottle but not so large as to slide off of the bottle. Contingent upon marketing and product needs, the hole size may change to accommodate different size bottle necks. The greeting card may also incorporate within the hole a portion that protrudes into the bottom of the hole that creates a pop-up image when the greeting card is placed on a bottled product. The pop-up image secures and centers the greeting on a bottled product. As shown in the embodiments of FIGS. 1 through 3, the pop-up image may have a curvature which is substantially inverse to the curvature of a bottle neck, and it may have a V-shaped point at the apex of its curvature. Also as shown, the pop-up image may extend into the cutout no greater than half the distance of the longest dimension of the cutout. The greeting card may also incorporate scoring 22 to assist a user in folding the card so that it hangs in a position closer to vertical.

The greeting itself is composed of three parts that conveys a complete greeting. The three greeting parts on the greeting card are; graphics, greeting text and signature box, and all three together convey a greeting that is entirely on the front side of the card.

The greeting card includes graphics 26. Although a specific photograph is illustrated to show an example of graphics 26 that may be included on the greeting card, it is understood that any graphics may be used on the greeting card. For example, graphics 26 may include photographs, hand drawn illustrations, or computer drawn graphics, and any of these may be edited with a computer graphics software program. Furthermore, graphics 26 may be of any color.

Photographs that may be incorporated as graphics 26 include pictures taken with a camera and placed in a computer file for editing with a computer software program. Such photographs may depict people, buildings, places and points of interest, nature, and any physical object that can be photographed. Additionally, such photographs may include pictures of hand drawn designs, such as, but not limited to, abstract designs, solid colors, and mixed colors. For example, a geometric design may be hand drawn on a poster board, and then photographed.

Hand-drawn illustrations that may be incorporated as graphics 26 may be drawn on paper, scanned to a computer, and edited to create a greeting card graphic. Along with geometric designs, hand drawn artwork may also include people, buildings, places and points of interest, nature, and any physical object that can be drawn. An example of hand drawn artwork may be a picture of a field of wild flowers with a barn in the background, or a still life picture of a carafe of wine on a table.

Computer-generated artwork that may be incorporated as graphics 26 includes artwork that can be drawn on a computer, like geometric designs, and pictures of people and objects. By using the tools on a computer system, such as, but not limited to, paint and pencil tools, we can create pictures of people, animals, and landscapes.

All graphics 26 may be edited with a computer graphics software program. Examples of editing a picture include, but are not limited to, adding objects to a picture, deleting objects in a picture, changing the color, shade, size, shape and contrast in a picture, and changing the appearance of a picture. For example, a picture may be changed to display an antique or oil paint finish. Another example of editing a picture is changing a rose to the color red in an otherwise black and white photograph.

The front side 10 of the greeting card also includes greeting text 16. Although a specific message is illustrated to show an example of greeting text 16 that may be included on the greeting card, it is understood that any content may be used as greeting text on the greeting card. Greeting text 16 may be hand printed or hand written in any color and style on a hand drawn picture, or also may be printed or written by a computer program with various fonts, font sizes and colors. The complete greeting text 16 appears of the front side 10 of the greeting card below the score 22. Additionally, it is understood that the greeting text 16 may be printed or written in other languages, such as Spanish. Types of greeting text may include, but are not limited to: Happy Birthday; Happy Holidays; Happy New Year; Merry Christmas; Thanks for Hosting; Thank You; Happy Anniversary; Happy Fathers Day; Happy Mothers Day; Congratulations; Compliments of. Furthermore, "Thank You" greetings may be more detailed, such as "Thank You for your Business," "Thanks for a job well done," "Thank You for your Support," and "Thanks for all your Help." Greeting messages also may include, but are not limited to: jokes; quotes; riddles; sayings; poetry lines; expressions; our own expressions; our own sayings; one liners; single words; rhymes; and our own poetry. Quotations may be from the Bible, famous and not so famous people. An example of a one liner is "tomorrow's another day," and an example of a single word is "dream" and "believe." An example of a saying is "like a fine wine, you get better with age."

The front side 10 of the greeting card also includes signature box 18. Although a specific format of signature box 18 is depicted to show an example of signature box 18 that may be included on the greeting card, it is understood that other formats may be used on the greeting card. Signature box 18 may be located on the bottom front side of the greeting card, and consists of graphics, the word "from" and a signature line where the sender(s) of the greeting/gift can sign their name (s). The word "from" may be printed or written by hand on a hand drawn picture, or may be done on a computer, and may come in various fonts, font sizes and colors. In addition the signature line can be any thickness and color. Graphics in signature box 18 may be a continuation of the photograph on the greeting card, but in a lighter shade, so the sender'(s) signature can be more prominent. The shape of the signature box is rectangular, and the standard size is 4" length and 1" wide; however the width size may vary. For instance, the width size may be ¾" instead of 1". If the greeting card is customized, the signature box may be deleted from the greeting. For instance, if a business is using the greeting card for promotional use, the business name may already be represented in the greeting text.

The front side 10 of the greeting card may include other items or text. For example, for illustrative purposes, front side 10 of FIG. 1 includes a public service message 12, brand or company name and logo 14, and company website address 20. Such features are optional, and other features, graphics, or text may be added without departing from the present invention.

FIG. 2 illustrates the back side 11 of one embodiment of the present invention. Precut hole 24 and scoring 22, as described above, are adapted to fit over the neck of a bottle and to assist in hanging the card in a position close to vertical. In some embodiments, scoring 22 may allow the card to hang close to vertical by being positioned below the precut hole 24. In other embodiments, scoring 22 may allow the card to hang close to vertical by being positioned across the precut hole 24. Other positions are possible, as necessary to allow the card to hang close to vertical over a particular bottle neck, as previously described. The back of the greeting card may be blank, but it also may optionally include additional information or graphics. For example, additional small graphics 30 may appear on the back 11. Further, the brand or company name and logo 14, and company website address 20, may appear on the back side 11. Finally, additional information relevant to the sale or marketing of the product may be included on the back. These optional items include a product name and trademark symbol 34, place of manufacture and/or price 36, company name and copyright symbol 38, "Made in USA" statement 40, "Patent Pending" statement 42, and UPC and barcode 32.

The greeting card of the present invention can be used as a greeting card on bottled gifts that not only sends a complete greeting for which the gift is purchased, but with the greeting card's openly displayed greeting that includes a signature box where the sender(s) of the gift can sign their name(s), creates a personal touch and dresses-up any gift for a complete gift presentation. For instance, a person may wish to purchase specialty bath oil for a friend's birthday. Instead of taping a greeting card enclosed in an envelope to the bath oil, or having to wrap the gift and attach an enclosed greeting card, the greeting card can be directly attached to the bottle that adds character and dress-up the gift offering with its colorful greeting. Another example is a couple attending a party and they wish to give the hostess a bottle of wine. By attaching a greeting card that reads, "Thanks for Hosting" on the bottle of wine, the greeting and sender(s) of the gift is openly displayed to add a more personal touch to the gift.

Another use for greeting card of the present invention is on packaged gifts. For instance, the greeting card can be taped to a packaged gift, and the bow can be placed over the precut hole in the greeting card. In using a greeting card attached to a gift, there is no need for a greeting card or gift tag.

With the greeting card's unique form, it also can be used as a promotional use card. For example, companies, businesses, organizations can promote their business, name and/or bottled product by attaching a greeting card. A distributor of bottled products may attach a greeting card for the holidays to promote their products, or a wine shop retailer may promote wine purchases by offering a free greeting card for gift purchases. Further, businesses can use a greeting card to promote their product by customizing the greeting to represent their product.

The greeting card can be customized in graphics, greeting text and signature box to meet the needs of businesses, companies, organizations, and any large group, like weddings, parties and conventions. Customization on a greeting card may include only customizing the photograph, only customizing the greeting text, customizing both the greeting text and photograph, and deleting the signature box. Customization may include a photograph of our customer's product, or the customer may want their name represented in the greeting text. All in all, greeting customization on a greeting card refers to any business, organization, company, or large group wishing to be represented in the greeting. The following are some examples of customization of a greeting card.

1. ABC Corporation wishes to contribute bottles of wine to promote their name at a holiday party with a greeting card attached to the wine that reads, "Happy Holidays . . . Compliments of ABC Corporation." The photograph on the greeting card is our own photograph of holiday scenery of snow covered pine trees. Since the sender(s) of the bottles of wine (ABC Corporation) are already represented in the greeting text, the signature box may be eliminated from the greeting card.

2. Jack Daniels Company wishes to promote their Tennessee Whiskey by offering a free greeting card to consumers that purchase their whiskey as a holiday gift. The greeting text on the greeting card is generic and reads, "Wishes of Peace, Joy and Happiness this Holiday Season" and the customized photo is from the Jack Daniels photo file of holiday scenery that depicts a bottle of Jack Daniels by a fireplace that is decorated with garland. Jack Daniels retains the signature box, so the person that purchased the whiskey as a gift can sign their name. The offering of a free greeting card may already be attached to the Jack Daniels whiskey, or may be distributed by a clerk. For instance, the clerk may ask the consumer if the whiskey is a gift purchase, and if they would like a free greeting card, compliments of Jack Daniels.

3. Jack Daniels Company wishes to promote their Tennessee Whiskey by conveying holiday greetings with a greeting card attached to their Tennessee whiskey that reads, "Enjoy the Spirit of the Holidays with Jack Daniels." The photograph is our photo of holiday scenery depicting a lighted pine tree next to an old red barn. The signature box may or may not be part of the greeting card.

4. Wholesalers, distributors and retailers may wish to customize a greeting card. For example, Mike, a retailer of wine and champagne may want a certain photograph from his own photo file depicted on a greeting card, along with a specific greeting he wishes to convey to his customers, like "Wishing you a healthy and prosperous New Year," that has a 18 font size print, along with his name below that reads, "Mike's Fine Wines and Gifts," that has an 8 font size print. Even though Mike's Fine Wines and gifts is represented in the greeting text with a much smaller font size, the signature box may be retained, so the customer may use the greeting card for their own use.

5. Businesses may customize a greeting card. For instance, XYZ Construction and Remodeling delivers customer appreciation by leaving a bottle of wine or spirits to their customers after job completion. XYZ attaches a greeting card to the bottle of wine with a customized greeting that reads, "Thank you for your business . . . XYZ Construction and Remodeling," and the photograph is our own photo of antique tools on a wooden shelf. The signature box is omitted and the photograph is edited with a computer graphics software program that gives the whole photograph an antique appearance.

Those of ordinary skill in the art will understand that the greeting card may be made of a variety of materials and may be of various dimensions. For example, the greeting card itself may be made of paper, plastic, a combination of those materials, or other materials altogether. In one embodiment, the greeting card is made of standard 80 or 100 lb. colored or white card stock paper. However, the greeting card also may be printed on heavier card stock, and other types of paper, such as parchment, and embossed paper. Furthermore, the greeting card may be rectangular with rounded edges on all four corners. However, a greeting card may be customized with a more square shape with rounded corners. Additionally, the greeting card may be approximately 4" wide, with a standard length of 8⅝". Both of those dimensions are variable, however; for example, if a greeting card is customized, the width and length of the card may be smaller or larger than the standard size. For example a liquor manufacturer may want a smaller length size, so the card will not cover the label of the product.

Although the present invention has been described with reference to preferred embodiments, persons skilled in the art will recognize that changes may be made in form and detail without departing from the spirit and scope of the invention.

We claim:

1. A bottle greeting card comprising: a card, consisting essentially of a front side of the card and the backside of the card, upon which graphics and text may be displayed; a cutout from the card adapted to fit over the neck of a bottle; a protrusion, positioned inside a perimeter of the cutout, having a curvature substantially inverse to a curvature of the bottle and a V-shaped point at the apex of its curvature, extending into the cutout no greater than half the distance of the longest dimension of the cutout, and adapted for stabilizing the position of the card on the bottle; at least one of graphics and text forming a greeting printed on the card; and one scored line adapted for folding to enable the card to hang in a generally vertical position.

2. The bottle greeting card of claim 1, wherein the cutout is rectangular in shape.

3. The bottle greeting card of claim 1, wherein the cutout is generally circular in shape.

4. The bottle greeting card of claim 1, wherein the diameter of the cutout is from one inch to three inches.

5. The bottle greeting card of claim 1, wherein the at least one of graphics and text printed on the card include a signature box.

6. The bottle greeting card of claim 1, wherein the scored line intersects the perimeter of the cutout at two points along the perimeter of the cutout.

7. The bottle greeting card of claim 1, wherein the scored line does not pass through the protrusion, thereby enabling the protrusion to secure the card in the generally vertical position.

8. The bottle greeting card of claim 1, wherein the protrusion extends into the cutout to a point which is less than half of a vertical length of the cutout.

9. A method for attaching a greeting card to a bottle, comprising: placing the greeting card having a greeting around a neck of the bottle through a cutout forms in the greeting card; folding the card along one scored line so that it lays flat against the bottle and hangs in a generally vertical position; and securing the card in the generally vertical position by abutting a protrusion against the side of the bottle, the protrusion being positioned inside a perimeter of the cutout, having a curvature substantially inverse to a curvature of the bottle and a V-shaped point at the apex of its curvature, and extending into the cutout no greater than half the distance of the longest dimension of the cutout.

10. The method of claim 9, wherein the scored line does not pass through the protrusion, thereby enabling the protrusion to secure the card in the generally vertical position.

* * * * *